United States Patent [19]

Gorrafa

[11] Patent Number: 4,945,618

[45] Date of Patent: Aug. 7, 1990

[54] AIR TEXTURING JET

[75] Inventor: Adly A. Gorrafa, Hockessin, Del.

[73] Assignee: E. I. Du Pont de Nemours and Company, Wilmington, Del.

[21] Appl. No.: 345,629

[22] Filed: Apr. 3, 1989

Related U.S. Application Data

[62] Division of Ser. No. 178,961, Apr. 7, 1988.

[51] Int. Cl.[5] ..... D02G 1/16

[52] U.S. Cl. ..... 28/254; 28/273

[58] Field of Search ..... 28/254, 273

[56] References Cited

U.S. PATENT DOCUMENTS

| | | | |
|---|---|---|---|
| 3,402,446 | 9/1968 | Benson | 28/1 |
| 3,835,510 | 9/1974 | Koslowski | 28/1.4 |
| 3,881,231 | 5/1975 | Price et al. | 28/1.4 |
| 4,097,975 | 7/1978 | Moeller | 28/254 |
| 4,104,770 | 8/1978 | Massey, Jr. et al. | 28/257 |
| 4,148,116 | 4/1979 | Price | 28/254 |
| 4,157,605 | 6/1979 | Agers | 28/254 |
| 4,183,123 | 1/1980 | Tanaka et al. | 28/273 |
| 4,507,833 | 4/1985 | Simmen | 28/254 |

OTHER PUBLICATIONS

Denton Textile Month, "Air Texturing and Intermingling", pp. 34–37, Jan. 1988.

Acar and Wray, vol. of Journal of Textile Institute, "An Analysis of Air-Jet Yarn-Texturing Process", Part VII, 1986.

*Primary Examiner*—Werner H. Schroeder

*Assistant Examiner*—Bradley Kurtz DeSandro

[57] ABSTRACT

A yarn treating jet is modified to locate a baffle at the outlet end of the jet. The baffle is positioned a fixed distance above the central axis of the jet and away from the outlet end of the jet such that the yarn and air follow the lower surface of the baffle to a point where the yarn leaves the baffle.

2 Claims, 2 Drawing Sheets

AIR TEXTURING JET

This is a division of application Ser. No. 07/178,961, filed 4/7/88.

BACKGROUND OF THE INVENTION

This invention relates to an apparatus for treating yarn with a pressured fluid in a jet. More particularly, it concerns a baffle and deflector arrangement at the outlet end of a yarn texturing jet.

Fluid jet processes are known for texturing or bulking yarn that employ both movable and fixed baffles positioned at various distances from the outlet end of the jet and at various angles to the yarn path to deflect yarn and fluid from a straight path as they leave the jet.

In making a yarn having crunodal loops, the texturing jet must forward the overfed yarn under sufficient tension to keep the yarn from wrapping on the feed rolls, and this tension is provided by the drag of the pressurized air which is moving much faster than the yarn. The air opens the yarn, whips the filaments about, forms loops in the filaments, then entangles them together into a structure which can retain the loops under the tensions which such yarns encounter when made into fabrics. The tension must be low at the jet exit to accumulate loops and form the entangled structure. Immediately thereafter, higher tension is desired to tighten the entangled structure and stabilize it.

A baffle against which the air and yarn impinge is often provided at the jet exit to provide a controlled air zone and to change the direction of yarn movement abruptly. Such baffles are especially necessary at high texturing speeds and air pressures. However, with known cylindrical baffle arrangements, the air divides around the baffle, and the portion of the air which follows the yarn continues to exert tension.

In the present invention, the majority of the air follows the lower surface of a baffle while the yarn moves around the lower surface of the baffle.

Wind-up tension is a good measure of texturing jet effectiveness in converting filamentary bulking overfeed into loops, which are well consolidated and integrated with each other into a stable and coherent yarn bundle. Good wind-up tension also yields a firm, rather than soft/mushy, textured yarn package. Yarn withdrawal from such firm packages is easy and uniform, without snags and tangles associated with soft, mushy packages.

High wind-up tension in texturing also yields packages with yarn that resists bulk pull-out in subsequent high tension operations, such as warping, tufting or knitting. Poor loop consolidation into the yarn bundle, as evidenced by low wind-up tension, is also undesirable in the finished fabric or carpet. Abrasion on the surface of such fabrics, during use, will generally yield plucked-filaments, scuffing, fuzzing and unattractive appearance in relatively short time. Yarns with well consolidated loops, integrated into a compact yarn bundle, generally resist scuffing and fuzzing longer when converted to fabrics or carpets. Texturing tension is measured post jet, and wind-up tension is measured pre-packaging. There is a parallel relationship between texturing tension and wind-up tension, although the former is generally much lower in magnitude than the latter. Yarns with low texturing tensions show low wind-up tensions, while yarns with high texturing tensions also show wind-up tensions in the high range.

With the present invention, textured yarn wind-up tension increases by a surprising amount, reaching 20 to 100% more than wind-up tension realized under similar conditions with jets of the prior art, such as Agers U.S. Pat. No. 4,157,605.

SUMMARY OF THE INVENTION

A yarn treating jet is modified to provide a baffle at its outlet end. The baffle has a peripheral surface wherein that portion of the surface nearest the outlet end is spaced from the outlet end a distance of from 0.1 to 2.0 minimum diameters of the bore of the jet, measured downstream of the location in the jet bore where the air impacts the yarn, and that portion of the surface nearest the central axis of the jet is spaced a distance above the central axis of from 0.1 to 3.0 of said minimum diameters. The baffle may have a circular, curvilinear or polygon cross section.

DETAILED DESCRIPTION OF THE PREFERRED EMBODIMENT

Figure 1:
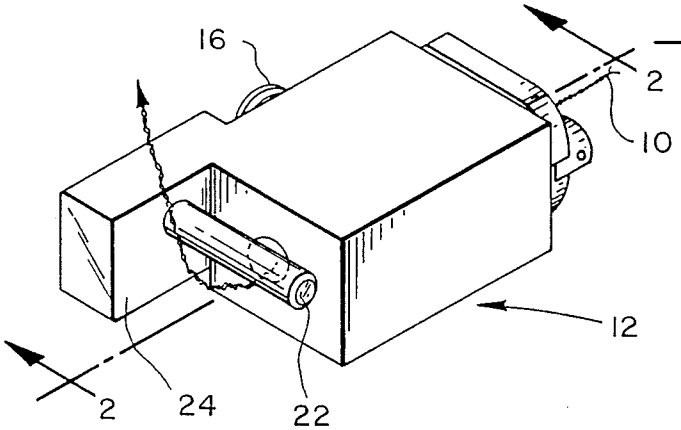
FIG. 1 is a perspective view of the jet apparatus of this invention.

In the embodiment chosen for purposes of illustration, yarn 10 enters a jet device 12 through inlet 14. Compressed air or other pressurized gas enters the jet device 12 through pipe 16 and impinges on yarn 10 in the entrance 17 of yarn outlet orifice block 18. The yarn and high velocity gas travel together through outlet end 20 of the jet and strike baffle 22 which is fixedly mounted to bracket 24 attached to the outlet end of the jet.

The central axis of baffle 22 is contained in a plane which is perpendicular to the central axis of jet device 12 and is located above the central axis of the jet such that the portion of the surface of the baffle nearest the central axis of the jet device is a distance A of from 0.1 to 2.0 minimum diameters of the bore downstream of the location where the pressurized gas contacts the yarn in the bore. More particularly, in the yarn outlet orifice block 18, said minimum diameter is the diameter indicated at location B. Preferably, distance A is from 0.5 to 1.5 minimum diameters. The baffle is also located a fixed distance C from the outlet end 20 of the jet's exhaust. This distance C is preferably in the range of from about 0.2 to about 1.2 of the minimum diameters referred to above. The size of the baffle 22 is selected so that the baffle is large enough to allow the yarn issuing from the jet outlet to travel 3.0 to 10.0, preferably 4.0 to 8.0 minimum diameters around said baffle before separating yarn from the gas flow.

In operation, yarn 10 is passed through jet 12 where it is treated with pressurized gas, then propelled by the gas from the outlet end of the jet to baffle 22 and travel partially around the lower surface of the baffle, then leave the baffle in an upward direction. Since the surface of the baffle nearest the central axis is above the central axis of the jet, most of the gas is diverted around the lower surface of the baffle.

Figure 2:
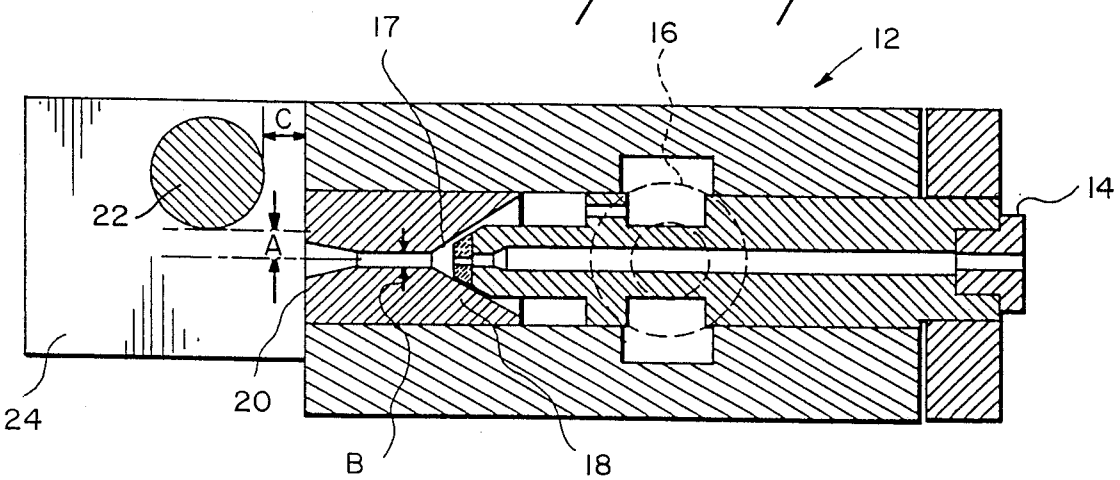
FIG. 2 is a sectioned view of FIG. 1 taken along line 2—2.
Figure 3:
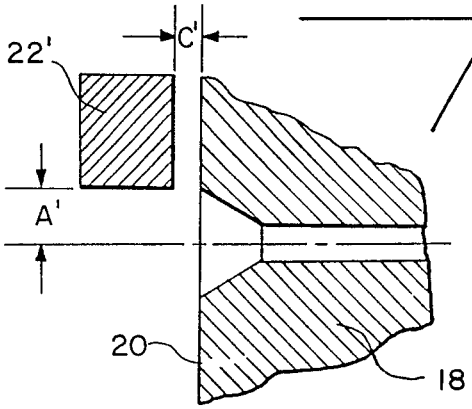
FIGS. 3 and 4 are partial views similar to FIG. 2 of the jet of this invention with baffles having square cross section, each oriented differently at the outlet end of the jet.
Figure 4:
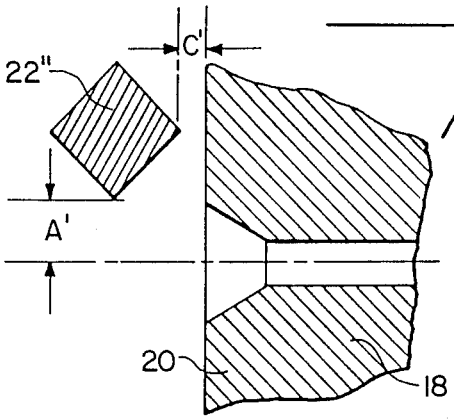

It is to be understood that the description "above" and "upward" is meant within the context of upward threadline path from the feed rolls to the take up rolls (not shown). In some machines, threadline path is downward in flow, in which case descriptive terms above and upwards should mean below and downward In the preferred embodiment illustrated in FIGS. 1 and 2, the baffle 22 is shown as a cylindrical rod with a circular cross section. FIGS. 3 and 4 illustrate alternate embodiments of the baffle in the form of polygons, in particular, square cross-section baffles 22,, 22,, In FIGS. 3 and 4 the distances C, and A, are from 0.5 to 1.0, preferably 0.5 to 0.9 minimum diameters and from 0.5 to 2.0, preferably 0.8 to 1.6 minimum diameters, respectively.

Figure 5:
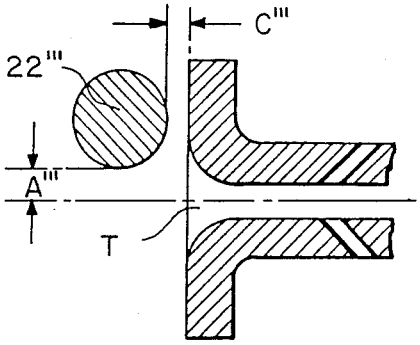
FIG. 5 is an illustration of a further embodiment showing the baffle in the form of a bar with a jet having a trumpet-like exit.

In FIG. 5 the relationship of the baffle 22''' to the trumpet-like outlet end of the jet device is shown and the distances C''' and A''' are from 0.1 to 2.0, preferably 0.2 to 0.5 minimum diameters and from 0.1 to 3.0, preferably 0.2 to 2.0 minimum diameters respectively.

What is claimed is:

1. In a yarn treating jet including a body having yarn inlet and outlet ends connected by a central bore along a central axis, means for introducing pressurized gas through a gas inlet into said bore between said ends to contact yarn passing through the jet at a location in said bore, said yarn and said gas following a path from said outlet end of said jet, the improvement comprising: a baffle located adjacent the yarn outlet end of the jet, said baffle having a square cross section oriented with adjacent flat surface portions facing said outlet end of the jet and said central axis, the flat surface portion nearest said outlet end being a distance from the outlet end of the 0.5 to 1.0 minimimum diameters of the bore and said flat surface portion nearest said central axis being a distance from said central axis of from 0.5 to 2.0 of said minimum diameters.

2. In a yarn treating jet including a body having yarn inlet and outlet ends connected by a central bore along a central axis, means for introducing pressurized gas through a gas inlet into said bore between said ends to contact yarn passing through the jet at a location in said bore, said yarn and said gas following a path from said outlet end of said jet, the improvement comprising: a baffle located adjacent the yarn outlet end of the jet, said baffle having a square cross section oriented with adjacent corners facing said outlet end and said central axis, the corner adjacent said outlet end being a distance from said outlet end of from 0.5 to 1.0 minimum diameters of the bore and the corners adjacent, said central axis being a distance from said central axis of from 0.5 to 2.0 of said minimum diameters.

* * * * *